US011008126B2

(12) United States Patent
Zheng

(10) Patent No.: US 11,008,126 B2
(45) Date of Patent: May 18, 2021

(54) VACUUM SEALING DEVICE

(71) Applicant: Yumyth Electronic Tech Co., LTD, Dongguan (CN)

(72) Inventor: Jian Zheng, Dongguan (CN)

(73) Assignee: Yumyth Electronic Tech Co., LTD, Dongguan (CN)

( * ) Notice: Subject to any disclaimer, the term of this patent is extended or adjusted under 35 U.S.C. 154(b) by 249 days.

(21) Appl. No.: 15/861,712

(22) Filed: Jan. 4, 2018

(65) Prior Publication Data

US 2019/0047733 A1 Feb. 14, 2019

(30) Foreign Application Priority Data

Aug. 11, 2017 (CN) ..... 201721010191.5

(51) Int. Cl.
*B65B 51/10* (2006.01)
*B65B 31/04* (2006.01)
*B65B 51/14* (2006.01)

(52) U.S. Cl.
CPC ..... *B65B 31/048* (2013.01); *B65B 51/10* (2013.01); *B65B 51/146* (2013.01)

(58) Field of Classification Search
USPC ..... 53/434, 512; 206/1.5; 141/65
See application file for complete search history.

(56) References Cited

U.S. PATENT DOCUMENTS 3,818,574 A * 6/1974 Reid ..... B65B 51/04 29/243.57
4,860,523 A * 8/1989 Teteishi ..... B65B 31/06 53/512
5,454,407 A * 10/1995 Huza ..... B60P 7/065 141/10
2004/0134359 A1* 7/2004 Schiro' ..... A47J 43/07 99/472
2005/0011166 A1* 1/2005 Germano ..... B65B 31/024 53/512
2005/0172834 A1* 8/2005 Lee ..... B65B 31/046 99/472
2005/0223682 A1* 10/2005 Sung ..... B65B 31/046 53/512
2013/0097967 A1* 4/2013 Picozza ..... B65B 31/00 53/408
2013/0232925 A1* 9/2013 Huang ..... B65B 31/048 53/510
2013/0264224 A1* 10/2013 Young ..... B65D 11/10 206/1.5

(Continued)

*Primary Examiner* — Anna K Kinsaul
*Assistant Examiner* — Chinyere J Rushing-Tucker

(57) ABSTRACT

A vacuum sealing device includes a sealing base and a sealing cover arranged on the sealing base, the sealing base is also provided with a push-pull assembly for pushing and pulling the sealing cover; the push-pull assembly includes two piston cylinders disposed at both ends of the sealing base, a piston assembly disposed within the piston cylinder and pivoted to said sealing cover, and a pneumatic assembly disposed in the sealing base and pushed the piston assembly to reciprocate within the piston cylinder. The vacuum sealing device solves the trouble that the original mechanical structure needs to close and open the seal cover manually, thus realizing automatically vacuum sealing functions, it releases hands and greatly increases the convenience of operation.

13 Claims, 6 Drawing Sheets

(56) References Cited

U.S. PATENT DOCUMENTS

| | | | | |
|---|---|---|---|---|
| 2015/0232210 | A1* | 8/2015 | Sung | B29C 66/8221 53/509 |
| 2016/0251102 | A1* | 9/2016 | Landolt | B65B 59/00 700/114 |
| 2018/0162569 | A1* | 6/2018 | Day | B65B 25/001 |

* cited by examiner

VACUUM SEALING DEVICE

FIELD OF THE INVENTION

The present invention relates to a vacuum device, and more particularly to a vacuum sealing device.

BACKGROUND OF THE INVENTION

The vacuum sealing machine is used for vacuum packaging. At present, the vacuum sealing machine in market is disposed a cover manually opened and closed. Workers put the mouth part of the packaging bag in the vacuum groove of the vacuum sealing machine, and then manually close the cover, the cover and the base is locked by mechanical fasteners so as to realize the functions of vacuum sealing However, manual operation is not only inconvenient, but also time-consuming and laborious. In view of the above defects, in order to increase the convenience of operation, it is necessary to design an automatic opening and closing vacuum sealing device.

SUMMARY OF THE INVENTION

To overcome the above-mentioned drawbacks, an object of the present invention is to provide a vacuum sealing device, which solves the problem that the current vacuum sealing machine is manually operated and caused the inconvenience for packaging.

The other object of the present invention is to provide a disassembly assembly unit of the vacuum sealing device, which is convenient to disassemble and assemble for cleaning the vacuum sealing machine.

To solve the above-mentioned drawbacks, The technical schemes of the present invention are as follows:

A vacuum sealing device includes a sealing base and a sealing cover arranged on the sealing base, the sealing base is also provided with a push-pull assembly for pushing and pulling the sealing cover;

The push-pull assembly includes two piston cylinders disposed at both ends of the sealing base, a piston assembly disposed within the piston cylinder and pivoted to the sealing cover, and a pneumatic assembly disposed in the sealing base and pushed the piston assembly to reciprocate within the piston cylinder.

The pneumatic assembly includes a vacuum pump arranged within the sealing base, the first electromagnetic valve and the second electromagnetic valve. The positive pressure nozzle of the vacuum pump is connected with the first electromagnetic valve by pipeline, and the negative pressure nozzle of the vacuum pump is connected with the second electromagnetic valve by pipeline. Both the first electromagnetic valve and the second electromagnetic valve are piped with the two piston cylinders so that negative pressure or positive pressure can be generated in the piston cylinder.

The piston assembly includes a piston arranged in the piston cylinder and a connecting member pivoted to the piston; the other end of the connecting member is pivoted with the sealing cover.

The sealing base is provided with a seat body, the top surface of the seat body are provided with a vacuum groove, a lower sealing strip is arranged surrounding the mouth of the vacuum groove, and a heating strip is arranged on the outside of the mouth of the vacuum groove; a sealing vacuum pump is disposed in the seat body, the sealing vacuum pump is connected with the vacuum groove by pipeline.

The vacuum groove is also provided with a collecting box, and a gas nozzle disposed on the vacuum groove passes through the collecting box and communicates with the sealing vacuum pump.

The vacuum sealing device is provided with a pressure sensor connected with the vacuum groove by pipeline. The vacuum sealing device has a control system, the pressure sensor is electrically connected to the control system. Therefore, the pressure sensor detects the negative pressure value in the vacuum groove and sends the detection result to the control system. When the detection result reaches the standard value, the control system makes a corresponding driving action.

The seat body is also provided with a relief solenoid valve connected to the vacuum groove by pipeline. The relief solenoid valve is opened before the sealing cover body needs to be opened. The outside air enters the vacuum tank so as to facilitate the opening of the sealing cover body.

The bottom surface of the sealing cover is provided with an upper sealing strip matched with the lower sealing strip on the sealing base and an upper sealing strip cooperated with the lower heating strip, so as to realize the sealing function.

The seal cover is also provided with an electronic balance.

The vacuum sealing device has a disassembly and assembly unit, which comprises two buckles arranged on both ends of the top surface of the sealing base, the upper portion of the buckle is provided with a hole; both sides of the sealing cover are respectively provided with a socket; the bottom surface of the sealing cover is provided with a slot corresponding to the buckle, the socket passes through the slots; when the sealing cover and the sealing base is connected, the upper portion of the buckle extends into the slot; a locking pin is inserted into the socket and passes through the hole of the buckle, so that the sealing cover and the sealing base are fixedly connected.

The locking pin also has a base, the base is protruded with a flake for holding and mounting the locking pin.

The front part of the locking pin is provided with a limiting slot, and the socket has a projection matched with the limiting slot so as to prevent the locking pin from falling off from the socket.

The top of the locking pin is provided with a cone-shaped head.

On both sides of the sealing cover is provided with a holding groove communicated with the socket, the base is contained in the holding groove.

Compared with the prior art, the vacuum sealing device comprises a sealing base and a sealing cover; the sealing base is provided with the push-pull assembly for pushing and pulling the sealing cover in it. When vacuum seal is required, the mouth part of the packaging bag can be placed in the vacuum groove on the sealing base. Using the push-pull assembly assembly to drive the sealing cover down, the sealing cover compacts the bag on the sealing base, thus the vacuum and sealing functions of the bag can be completed. After the packaging bag is packaged, the push-pull assembly assemble pushes the sealing cover out automatically, which solves the trouble that the original mechanical structure needs to close and open the seal cover manually, thus realizing automatically vacuum sealing functions, it releases hands and greatly increases the convenience of operation.

DETAILED DESCRIPTION OF ILLUSTRATED EMBODIMENTS

Figure 1:
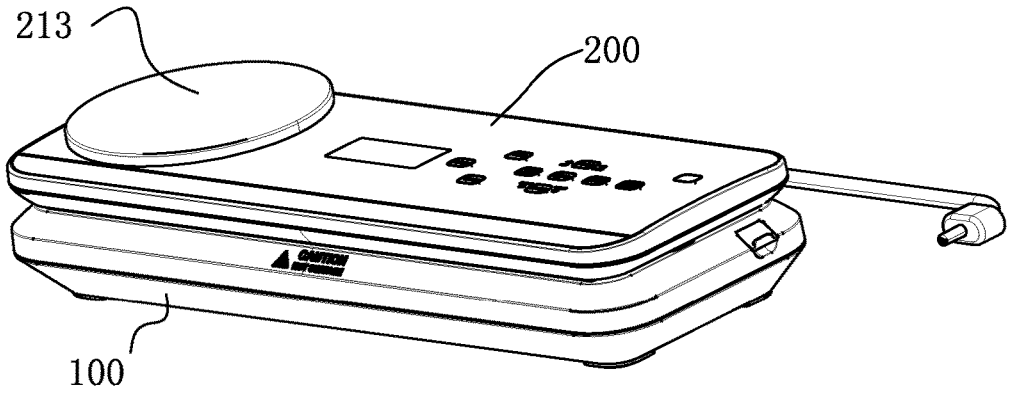
FIG. 1 is a perspective view of the vacuum sealing device in the present invention.
Figure 2:
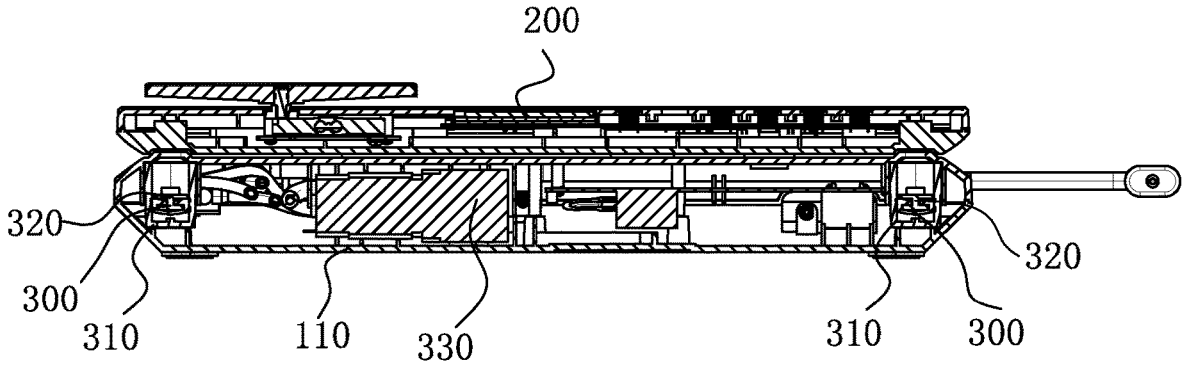
FIG. 2 is an explode view of the vacuum sealing device shown in FIG. 1.
Figure 3:
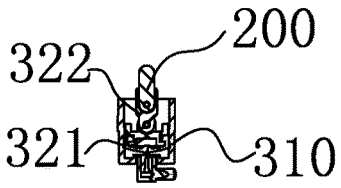
FIG. 3 is an explode view of the piston assembly 320 and the piston cylinder 310 of the present invention.
Figure 4:
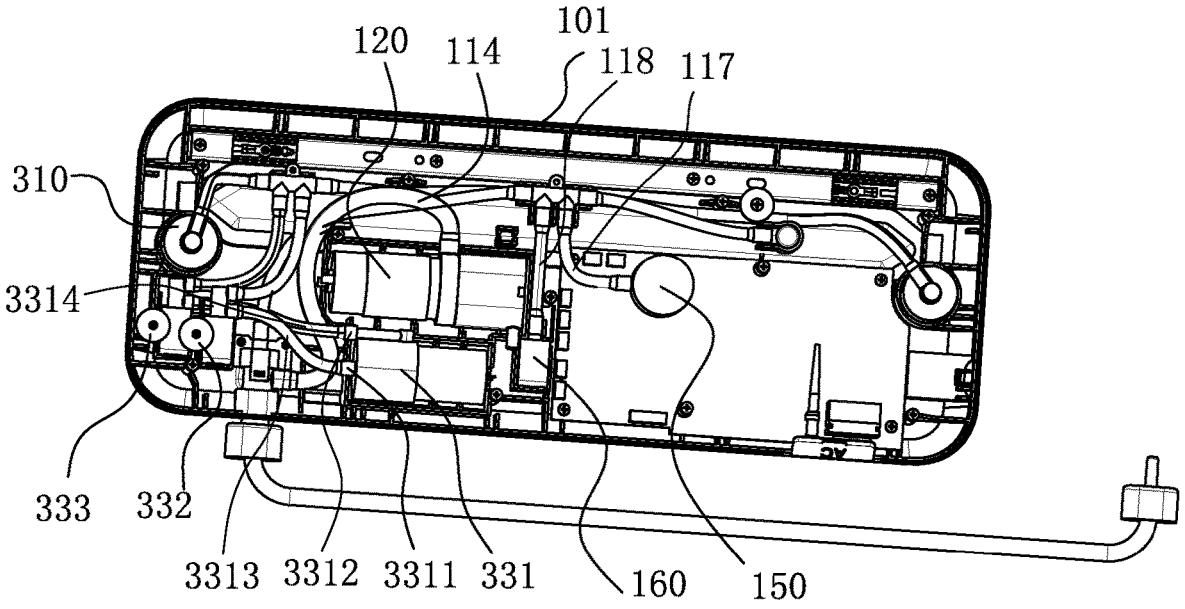
FIG. 4 is an internal perspective view of the sealing base of the vacuum sealing device of the present invention.
Figure 5:
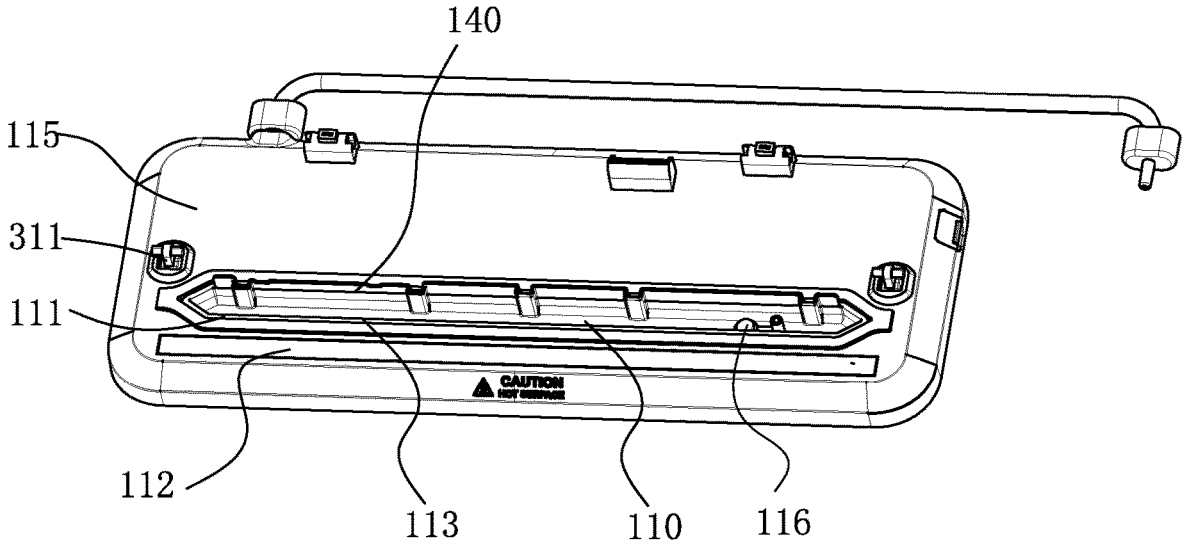
FIG. 5 is a perspective view of the sealing base of the vacuum sealing device of the present invention.
Figure 6:
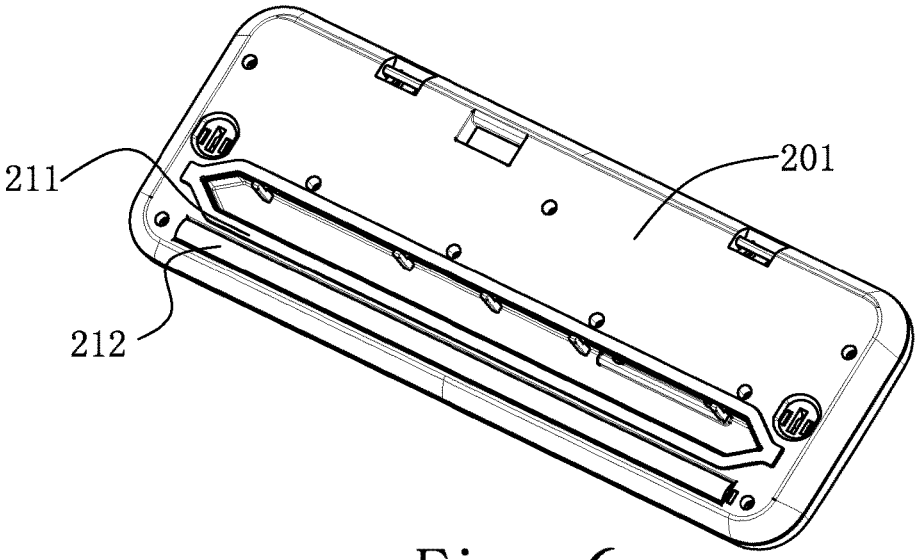
FIG. 6 is a perspective view of the sealing cover of the vacuum sealing device of the present invention.

In order to concretely illustrate the technical solutions and structure features of the furniture connecting piece of the present invention, the follow will further illustrate with specific embodiments and the drawings.

Referring to FIG. 1, FIG. 2, FIG. 3, FIG. 4, FIG. 5 and FIG. 6, the vacuum sealing device includes a sealing base 100 and a sealing cover 200 with a bottom surface 201 set on the sealing base. The sealing base 100 is also provided with a push-pull assembly 300 for pushing and pulling the sealing cover 200 in it. When vacuum sealing is needed, the mouth of the packaging bag can be put on the sealing base 100, and the push-pull assembly 300 pushes the sealing cover 200 with a bottom surface 201 to move down, therefore pressing the packing bag on the sealing base 100. After the vacuum sealing is done, the push-pull assembly 300 automatically pushes the sealing cover 200 from the mouth part of the packaging bag. It solves the problem that the original mechanical structure needs to push and pull the sealing cover 200 manually, releases the hands and greatly increases the operation convenience, therefore realizing automatic vacuum and sealing function.

The push-pull assembly 300 includes two piston cylinders 310 disposed at both ends of the sealing base 100, two piston assemblies 320 disposed within the two piston cylinders 310 respectively and pivoted to the sealing cover 200, and a pneumatic assembly 330 disposed in the sealing base 100 and pushed the piston assembly 320 to reciprocate within the piston cylinder 310. Through the pneumatic assembly 330 makes the piston cylinder 310 to form positive pressure or negative pressure, so that the piston 320 pushes or pulls the sealing cover 200.

The pneumatic assembly 330 includes a vacuum pump 331 arranged within the sealing base 100, the first electromagnetic valve 332 and the second electromagnetic valve 333. The vacuum pump 331 is provided with a positive pressure nozzle 3311 and a negative pressure nozzle 3312. The positive pressure nozzle 3311 of the vacuum pump 331 is connected with the first electromagnetic valve 332 by a first pipeline 3313, and the negative pressure nozzle 3312 of the vacuum pump 331 is connected with the second electromagnetic valve 333 by a second pipeline 3314. Both the first electromagnetic valve 332 and the second electromagnetic valve 333 are piped with the two piston cylinders 310 so that negative pressure or positive pressure can be generated in the piston cylinder 310.

The pneumatic assembly 330 may also be a piston-type air pump connected to the pipe of the piston cylinder 310 or an electric screw pushing mechanism for pushing the exhaust tube to move.

The piston assembly 320 includes a piston 321 arranged in the piston cylinder 310 and a connecting member 322 pivoted to the piston 321; The other end of the connecting member 322 is pivoted with the sealing cover 200.

The sealing base 100 is provided with a seat body 101 with top surface 115, the top surface 115 of the seat body 100 are provided with a vacuum groove 110 with a mouth 113, a lower sealing strip 111 is arranged surrounding the mouth 113 of the vacuum groove, and a lower heating strip 112 is arranged on the outside of the mouth 113 of the vacuum groove 110; a sealing vacuum pump 120 is disposed in the seat body 101, the sealing vacuum pump 120 is connected with the vacuum groove 110 by a third pipeline 114. When the packing bag is sealed, the mouth of the package bag is placed in the vacuum groove 110, and the air in the bag is extracted by the sealing vacuum pump 120.

The vacuum groove 110 is also provided with a collecting box 140 in it, and a gas nozzle 116 disposed on the vacuum groove 110 passes through the collecting box 140 and communicates with the sealing vacuum pump 120. Therefore, when the packaging bag is evacuated, the juice in the packaging bag is sucked into the collecting box 140, which is convenient for cleaning.

The vacuum sealing device is provided with a pressure sensor 150 connected with the vacuum groove 110 by a fourth pipeline 117. The vacuum sealing device has a control system, the pressure sensor 150 is electrically connected to the control system. Therefore, the pressure sensor 150 detects the negative pressure value in the vacuum groove and sends the detection result to the control system. When the detection result reaches the standard value, the control system makes a corresponding driving action.

The seat body 101 is also provided with a relief solenoid valve 160 connected to the vacuum groove 110 a fifth pipeline 118. The relief solenoid valve 160 is opened before the sealing cover body 200 needs to be opened. The outside air enters the vacuum tank so as to facilitate the opening of the sealing cover body 200.

The bottom surface 201 of the sealing cover 200 is provided with an upper sealing strip 211 matched with the lower sealing strip 111 on the sealing base 100 and an upper heating strip 212 cooperated with the lower heating strip 112, so as to realize the sealing function.

The seal cover 200 is also provided with an electronic balance 213. Before or after the closure, the weight of the packaged article may be measured by the electronic scale 213.

Figure 7:
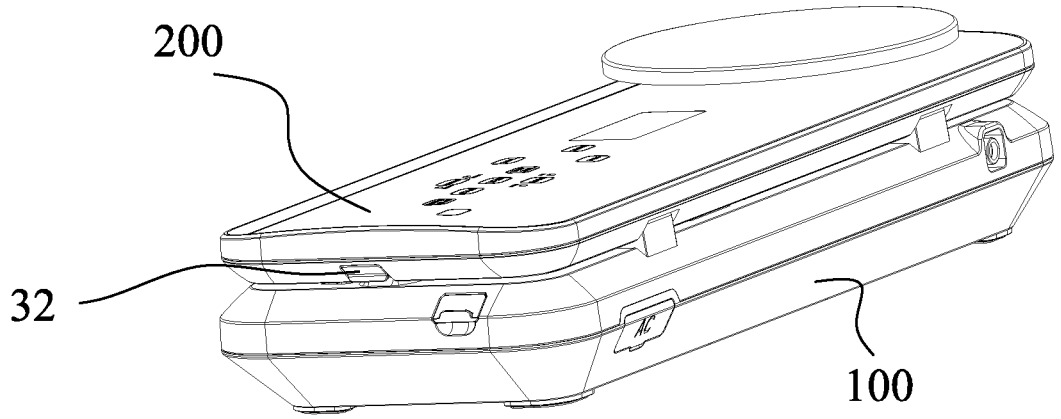
FIG. 7 is another perspective view of the vacuum sealing device in the present invention.
Figure 8:
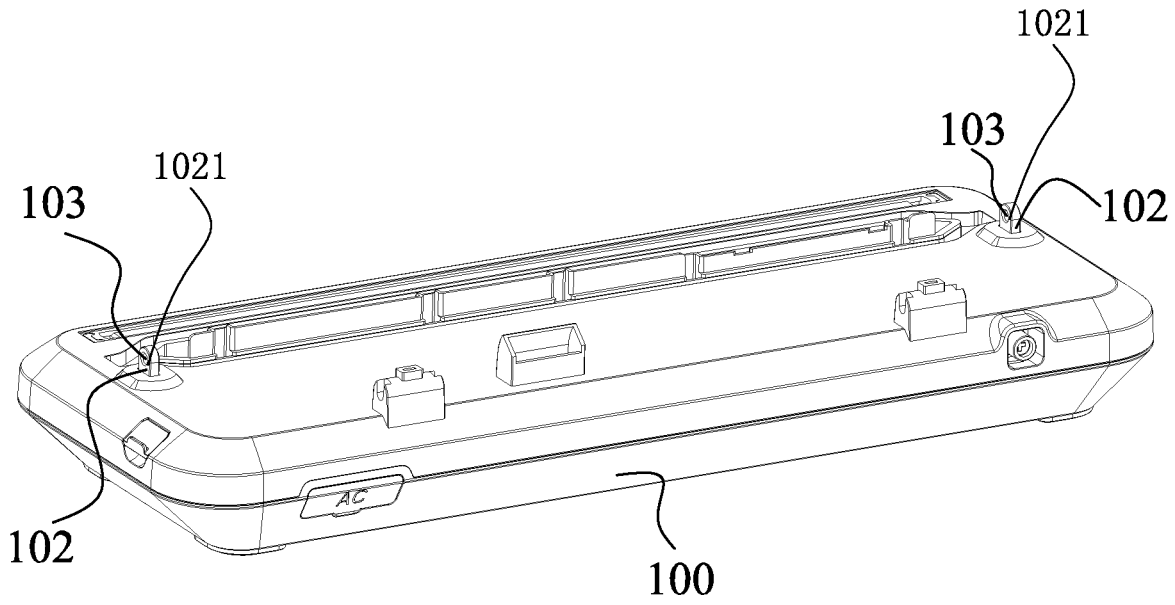
FIG. 8 is another perspective view of the sealing base in the present invention.
Figure 9:
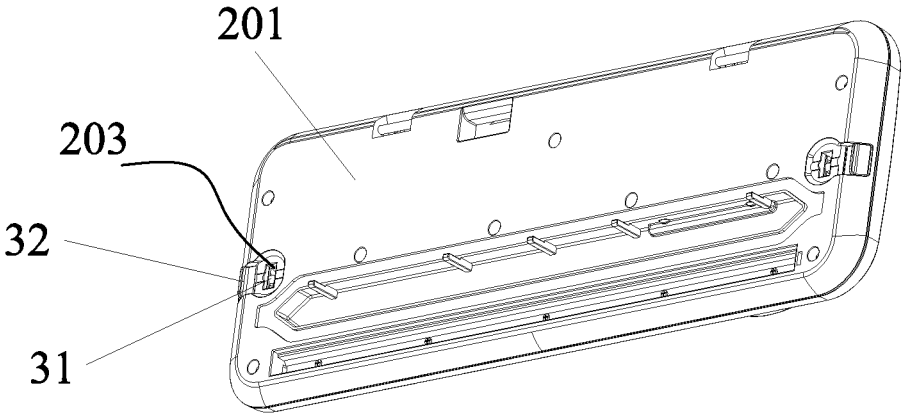
FIG. 9 is a perspective view of the sealing cover 200 and the interlocking nail in the present invention.

Referring to FIG. 7, FIG. 8 and FIG. 9, the vacuum sealing device has a disassembly and assembly unit, which comprises two buckles 102 with upper portions 1021 arranged on both ends of the top surface of the sealing base 100, each of the upper portions 1021 of the two buckles 102 is provided with a hole 103. Both sides of the sealing cover 200 are respectively provided with a socket 202; the bottom surface 201 of the sealing cover 200 is provided with two slots 203 corresponding to the two buckles 102, the socket 202 passes through one of the two slots 203. When the sealing cover 200 and the sealing base 100 is connected, the upper portions of the buckles 102 extend into the two slots 203; a locking pin 31 is inserted into the socket 202 and passes through the hole 103, so that the sealing cover 200 and the sealing base 100 are fixedly connected.

Figure 10:
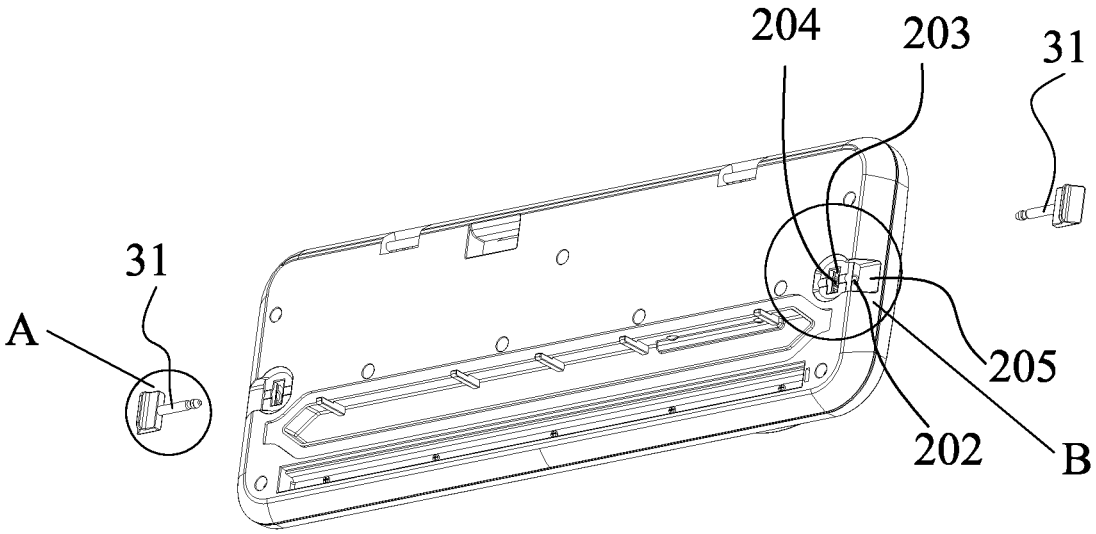
FIG. 10 is a schematic structural diagram of the exploded view of FIG. 9.
Figure 10A:
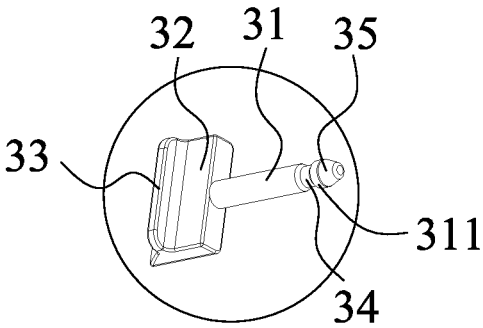
FIG. 10A is an enlarged view of a portion referenced as A in FIG. 10.
Figure 10B:
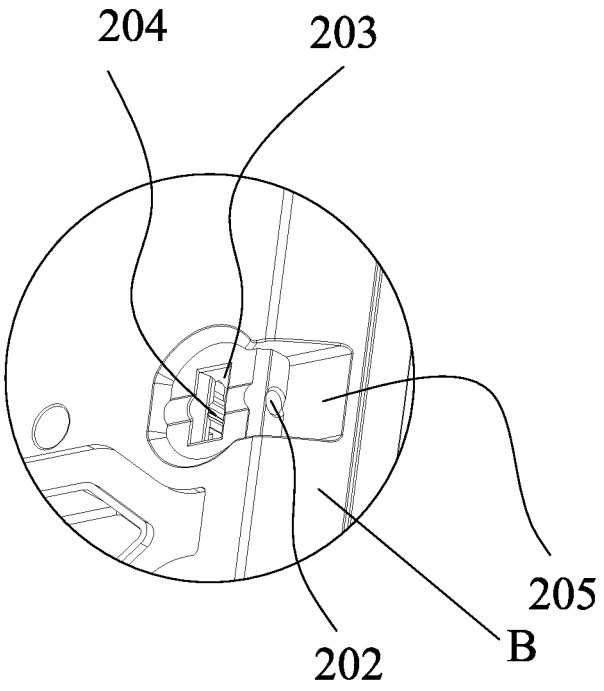
FIG. 10B is an enlarged view of a portion referenced as B in FIG. 10.

Referring to FIG. 10, the locking pin 31 also has a base 32. The base 32 is protruded with a flake 33 for holding and mounting the locking pin 31. When the locking pin 31 is inserted into the socket 202, the flake 33 is turned, thereby conveniently withdrawing the locking pin 31 from the socket 202, Or the flake 33 is pushed so that the locking pin 31 is inserted into the socket 202.

The locking pin 31 has a front part 311. The front part 311 of the locking pin 31 is provided with a limiting slot 34, and the socket 202 has a projection 204 matched with the limiting slot 34 so as to prevent the locking pin 31 from falling off from the socket 202.

Preferably, the locking pin 31 has a top 35, the top 35 of the locking pin 31 is provided with a cone-shaped head so that the locking pin 31 is conveniently inserted into the socket 202 and the hole 103.

Figure 11:
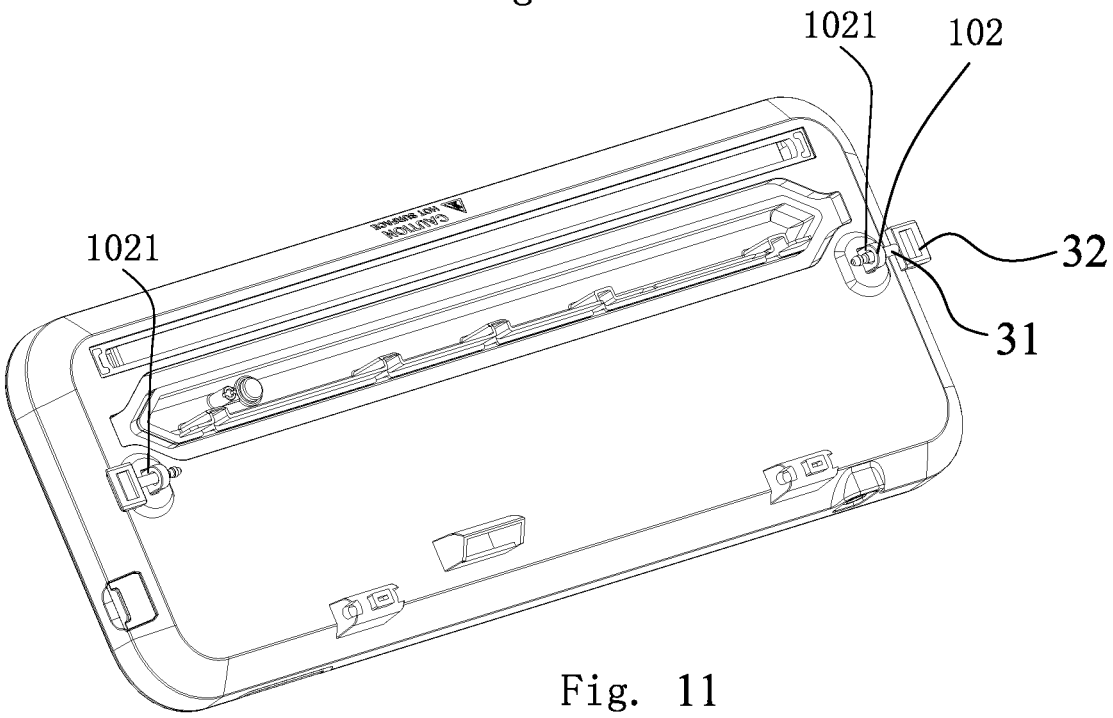
FIG. 11 is a structural diagram of the locking pin 31 used in conjunction with the clasp 102.

Preferably, refer to FIG. 10 and FIG. 11, on both sides of the sealing cover 200 is provided with a holding groove 205, the holding groove 205 and the socket 202 is communicated with the socket 202. The base 32 is contained in the holding groove 205, so as to ensure that the appearance of the sealing cover is beautiful.

The disassembly and assembly unit is convenient to disassemble and assemble the sealing base and the sealing cover for cleaning the vacuum sealing device.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

The invention claimed is:

1. A vacuum sealing device includes a sealing base and a sealing cover with a bottom surface arranged on said sealing base, wherein said sealing base is also provided with a push-pull assembly for pushing and pulling said sealing cover to open or close it from said sealing base;

said push-pull assembly includes two piston cylinders disposed at both ends of said sealing base, two piston assemblies disposed within said two piston cylinders respectively and pivoted to said sealing cover, and a pneumatic assembly disposed in said sealing base and pushes said two piston assemblies to reciprocate within said two piston cylinders; said pneumatic assembly produces positive pressure or negative pressure in said two piston cylinders, so that said two piston assemblies push or pull said sealing cover to open and close from said sealing base;

each of said two piston assemblies includes a piston arranged in each of said two piston cylinders and a connecting member pivoted to said piston; the other end of said connecting member is pivoted with said sealing cover;

wherein said seal cover is also provided with an electronic balance.

2. The vacuum sealing device according to claim 1, wherein said pneumatic assembly includes a vacuum pump with a positive pressure nozzle and a negative pressure nozzle, a first electromagnetic valve and a second electromagnetic valve; said the positive pressure nozzle of said vacuum pump is connected with said first electromagnetic valve by a first pipeline, and said the negative pressure nozzle of said vacuum pump is connected with said second electromagnetic valve by a second pipeline; both said first electromagnetic valve and said second electromagnetic valve are piped with said two piston cylinders so that negative pressure or positive pressure can be generated in said piston cylinder.

3. The vacuum sealing device according to claim 1, wherein said sealing base is provided with a seat body with a top surface, said top surface is provided with a vacuum groove with a mouth, a lower sealing strip is arranged surrounding said mouth, and a lower heating strip is arranged outside of said mouth; a sealing vacuum pump is disposed in said seat body, said sealing vacuum pump is connected with said vacuum groove by a third pipeline.

4. The vacuum sealing device according to claim 3, wherein the vacuum groove is also provided with a collecting box, and a gas nozzle disposed on said vacuum groove passes through said collecting box and communicates with said sealing vacuum pump.

5. The vacuum sealing device according to claim 3, wherein said vacuum sealing device is provided with a pressure sensor connected with said vacuum groove by a fourth pipeline.

6. The vacuum sealing device according to claim 3, wherein said seat body is also provided with a relief solenoid valve connected to said vacuum groove by a fifth pipeline.

7. The vacuum sealing device according to claim 1, wherein said bottom surface of said sealing cover is provided with an upper sealing strip matched with said lower sealing strip on said sealing base and an upper heating strip cooperated with said lower heating strip on said sealing base.

8. The vacuum sealing device according to claim 1, wherein said sealing base is provided with a seat body with a top surface, said vacuum sealing device has a disassembly and assembly unit, which comprises two buckles with upper portions arranged on both ends of said top surface of said seat body, each of said upper portions of said two buckles is provided with a hole; both sides of said sealing cover are respectively provided with a socket; said bottom surface of said sealing cover is provided with two slots corresponding to said two buckles, said socket passes through one of said two slots; when said sealing cover and said sealing base is connected, said upper portions of said two buckles extend into said two slots; a locking pin is inserted into said socket and passes through said hole, so that the sealing cover and said sealing base are fixedly connected.

9. The vacuum sealing device according to claim 8, wherein said locking pin also has a base, said base is protruded with a flake for holding and mounting said locking pin.

10. The vacuum sealing device according to claim 9, wherein said locking pin has a front part, said front part is provided with a limiting slot, and said socket has a projection matched with said limiting slot so as to prevent said locking pin from falling off from said socket.

11. The vacuum sealing device according to claim 9, wherein said locking pin has a top, said top of said locking pin is provided with a cone-shaped head.

12. The vacuum sealing device according to claim 11, wherein said top of said locking pin is arranged as a conical head.

13. The vacuum sealing device according to claim 8, wherein on both sides of said sealing cover is provided with a holding groove communicated with said socket, said base is contained in said holding groove.

* * * * *